US006802089B2

(12) United States Patent
Cropelli

(10) Patent No.: US 6,802,089 B2
(45) Date of Patent: Oct. 12, 2004

(54) COMBINED SLIDING RAIL WITH SUPPORT FOR HEIGHT-ADJUSTABLE SHOWER

(75) Inventor: Serafino Cropelli, Lumezzane S.A. (IT)

(73) Assignee: Sanicro S.r.l., Cailiona di Villa Carcina (IT)

( * ) Notice: Subject to any disclaimer, the term of this patent is extended or adjusted under 35 U.S.C. 154(b) by 0 days.

(21) Appl. No.: 10/210,477

(22) Filed: Aug. 1, 2002

(65) Prior Publication Data

US 2003/0115667 A1 Jun. 26, 2003

(30) Foreign Application Priority Data

Dec. 21, 2001 (IT) ..... BX/2001/U/105

(51) Int. Cl.[7] ..... A47K 4/00

(52) U.S. Cl. ..... 4/570; 4/567; 4/568; 248/297.31; 248/477

(58) Field of Search ..... 4/615, 567, 568, 4/570; 248/295.11, 297.21, 297.31, 477; D8/376, 377; 403/107, 108

(56) References Cited

U.S. PATENT DOCUMENTS

| | | | | | |
|---|---|---|---|---|---|
| 707,941 | A | * | 8/1902 | Pope | 248/48.1 |
| 1,264,837 | A | * | 4/1918 | Moen | 248/297.21 |
| 1,755,453 | A | * | 4/1930 | Mullen | 248/48.1 |
| 2,052,420 | A | * | 8/1936 | Peterson | 4/617 |
| 2,569,622 | A | * | 10/1951 | Trainor | 248/477 |
| 2,598,092 | A | * | 5/1952 | Alvey | 4/615 |
| 2,685,093 | A | * | 8/1954 | Lundquist | 4/615 |
| 3,078,484 | A | * | 2/1963 | Briggs | 15/21.1 |
| 3,737,107 | A | * | 6/1973 | Wright | 239/588 |
| 3,806,963 | A | * | 4/1974 | Flynn | 4/615 |
| 4,360,159 | A | * | 11/1982 | Haynes | 239/282 |
| 4,561,136 | A | * | 12/1985 | Baer | 4/615 |
| 4,826,210 | A | * | 5/1989 | Schmidt | 280/808 |
| 4,914,759 | A | * | 4/1990 | Goff | 4/605 |
| 5,044,666 | A | * | 9/1991 | Griesemer | 280/801.2 |
| 5,692,712 | A | * | 12/1997 | Weinschenk et al. | 248/118 |
| 5,833,192 | A | * | 11/1998 | Buhrman | 248/295.11 |
| 5,853,222 | A | * | 12/1998 | Roslund et al. | 297/353 |
| 5,857,227 | A | * | 1/1999 | Trusty et al. | 725/56 |
| 6,105,182 | A | * | 8/2000 | Elnar | 4/541.1 |
| 6,216,993 | B1 | * | 4/2001 | Morris | 248/302 |
| 6,550,079 | B2 | * | 4/2003 | Gransow et al. | 4/567 |

* cited by examiner

*Primary Examiner*—Henry Bennett
(74) *Attorney, Agent, or Firm*—McGlew and Tuttle, P.C.

(57) ABSTRACT

A sliding rail consisting of two standards reciprocally defining a slotting wherein there is housed a shower support, into which there is obtained a recess intended to partly house a block forming a sliding guide for the support on the slotting. The sliding being allowed by the horizontal pivoting of the support relative to the block and by the consequent insertion or removal of the teeth provided on the support.

10 Claims, 4 Drawing Sheets

COMBINED SLIDING RAIL WITH SUPPORT FOR HEIGHT-ADJUSTABLE SHOWER

FIELD OF THE INVENTION

The present invention relates to a combined sliding rail with support for height-adjustable shower which, with a single move for positioning, allows adapting and blocking the shower support at the height desired by the user.

BACKGROUND OF THE INVENTION

As known, one of the most frequent problems in the field of bathroom fixtures relates to the variation of the height of a shower support applied to a so-called sliding rail. In fact, several differently shaped sliding rails, substantially tubular, have been proposed so far, to which shower supports are applied, the height of which can be adjusted by tightening flywheels acting radially to the same sliding rail.

It is also known that such adjustments are totally unstable, both as regards the stability of the desired height, and as a consequence with regard to the shower inclination.

SUMMARY AND OBJECTS OF THE INVENTION

An object of the present finding is to remedy the above disadvantages by proposing a sliding rail with support whose configuration should make its use easier and more effective, by allowing a very simple height adjustment of the shower support and, above all, locking it to the desired position of use.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
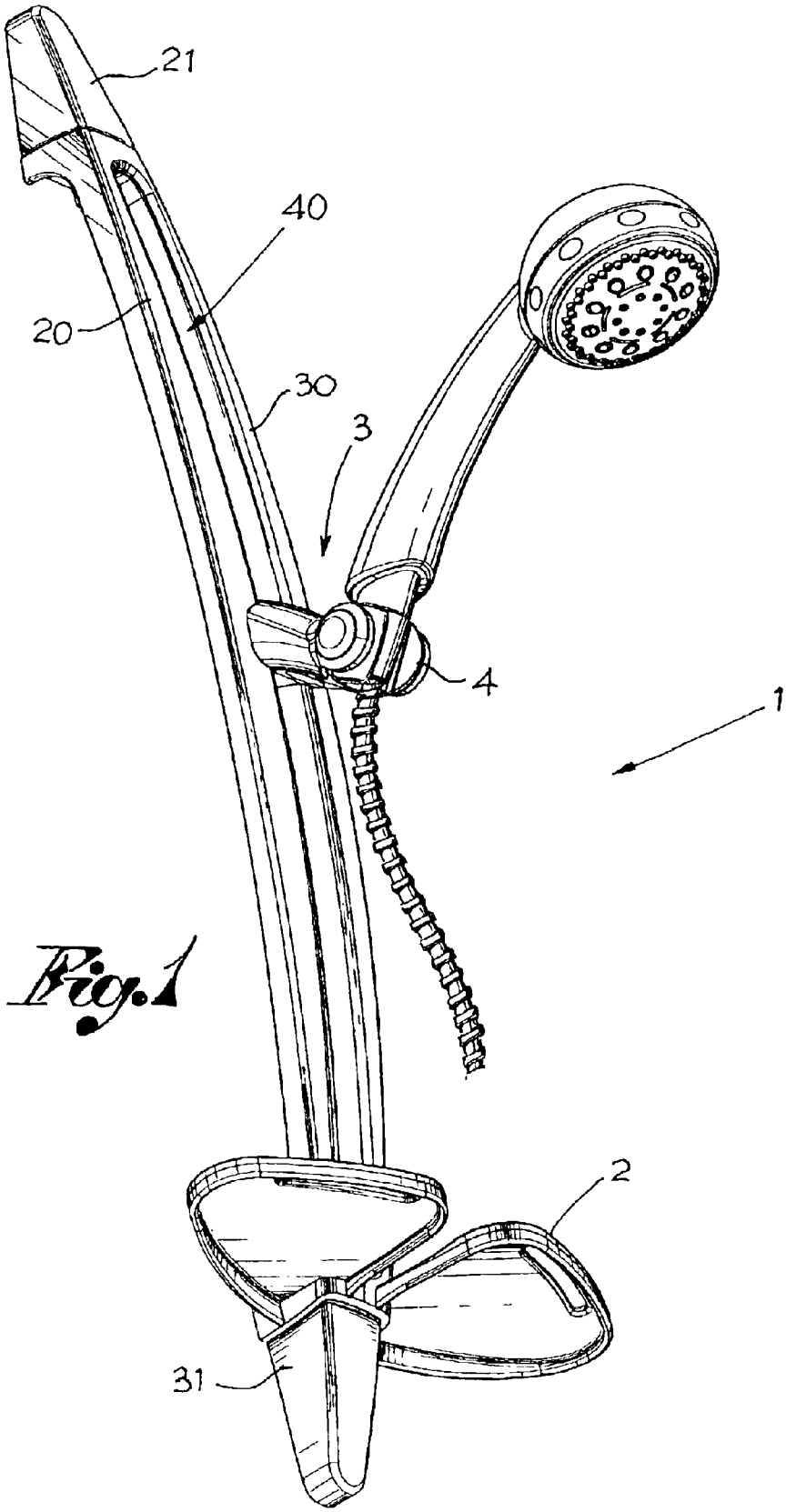
FIG. 1 shows the sliding rail fitted with shower.

In such drawings, reference numeral 1 denotes a sliding rail for a shower, optionally provided with a soap-holder support 2, consisting of two standards or struts 20 and 30 defining a slotting 40. The sliding rail 1 exhibits, at its opposed ends, two members 21 and 31 for fixing the rail 1 to the wall.

Moreover, a hollow support 3 is suitably engaged to the sliding rail 1, and provided with an adjustable tilt head 4 intended to hold a shower 5 in a known manner.

According to the invention, in its hidden portion, that is, in the concave side portion facing the wall to which it is fixed and adjacent the two sides 41 and 51 of slotting 40 and for its full length, sliding rail 1 exhibits two undulated ribs 42, 52 defining a sort of rack.

In turn, support 3 consists of a visible front portion 6 that in its upper part extends with an appendix 61 exhibiting, in the end opposite to head 4, a pair of teeth 62 intended to engage with the notches provided on ribs 42 and 52.

Orthogonally and in the lower side of said appendix 61, a plate-shaped rib 63 is provided with through holes having an axis orthogonal to the rib 63 and coplanar to appendix 61, wherein pin 64 is housed.

Figure 2:
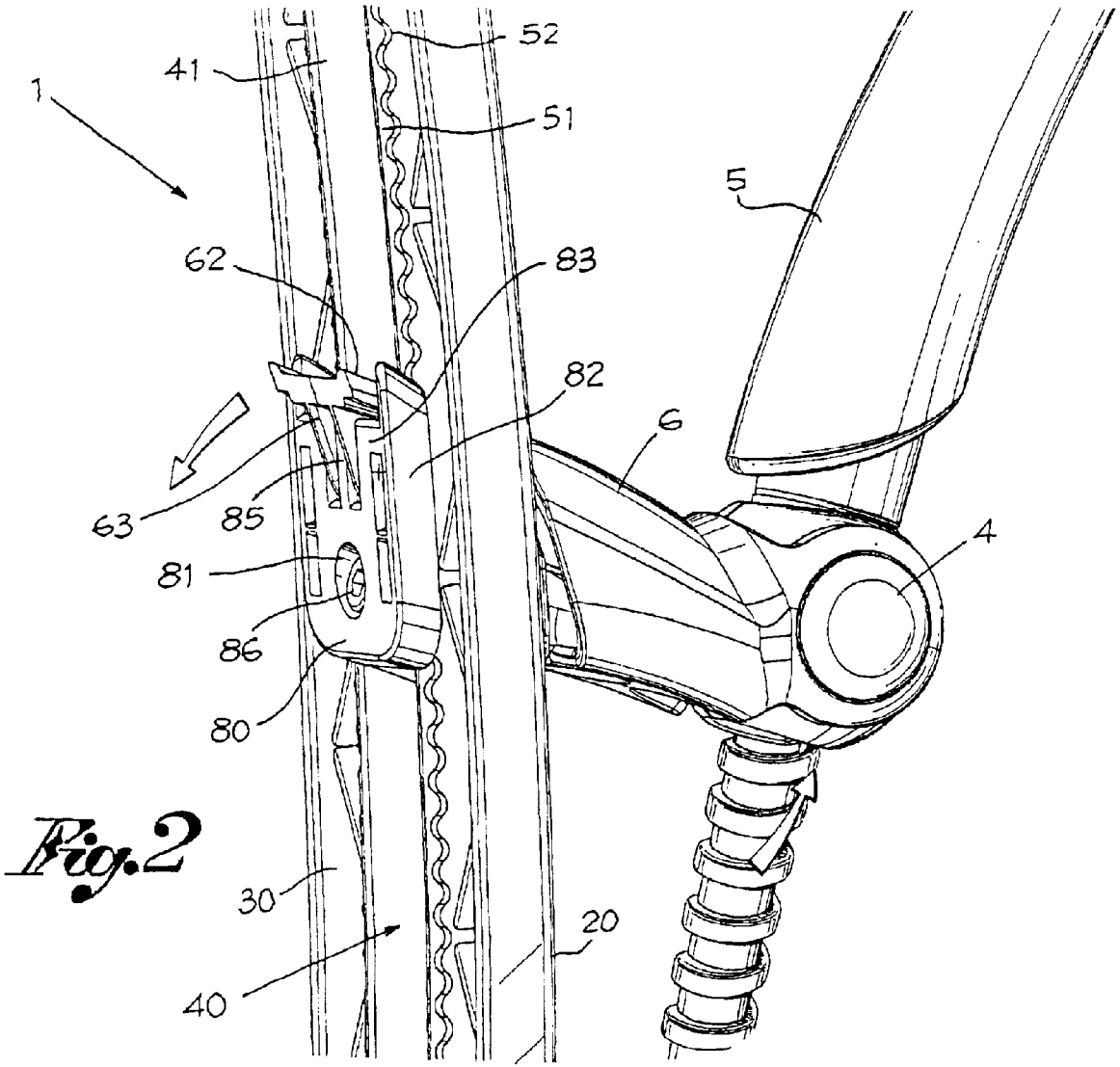
FIG. 2 shows a rear perspective view of the details of the sliding rail with the shower support.

As shown in FIG. 2, appendix 61 with teeth 62 goes through slotting 40 so that the teeth 62 are in the hidden rear side of sliding rail 1.

According to the finding, support 3 exhibits a recess 31 wherein a block 70 is partly housed. The block 70 consists of a substantially prismatic central body 71 developing from two tongues 72 complementary to recess 31 of support 3. The central body 71 exhibits two cradles 73 in its upper portion, placed in abutment with the free ends of pin 64 and, in the lower portion of said cradles 73, a threaded hole 74 is provided (see FIG. 4).

Similarly and complementary to block or first plate 70, there is provided a plaque or second plate 80 exhibiting a central through hole 81, two side tongues 82, two teeth 83 defining as many undercuts 84, and a central tooth 85. Undercuts 84 are configured so as to enclose the free portions of pin 64. Hole 81 is provided for receiving a bolt 86 intended to be screwed into threaded hole 74 so as to firmly engage plaque or plate 80 to block 70, concurrently allowing support 3 to horizontally pivot, thanks to pin 64 enclosed between cradles 73 and undercuts 84, relative to the group consisting of block 70 and plaque or plate 80.

Figure 3:
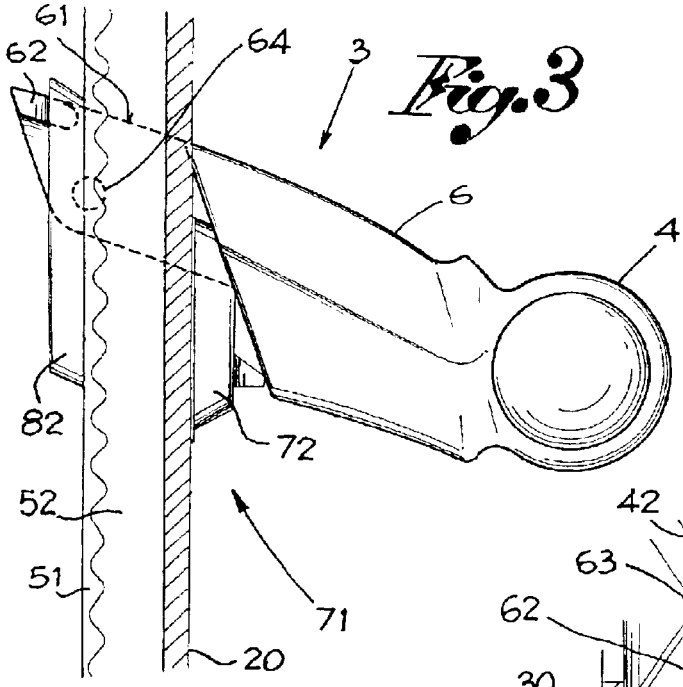
FIG. 3 shows a longitudinal section view of the sliding rail and the shower support during height adjustment.
Figure 7:
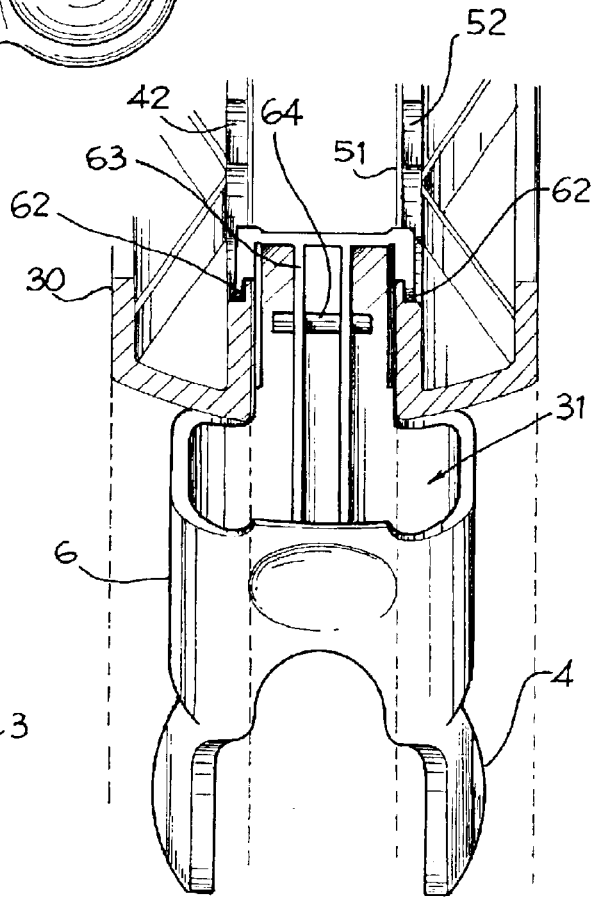
FIG. 7 shows a plan bottom view of the above support.
Figure 4:
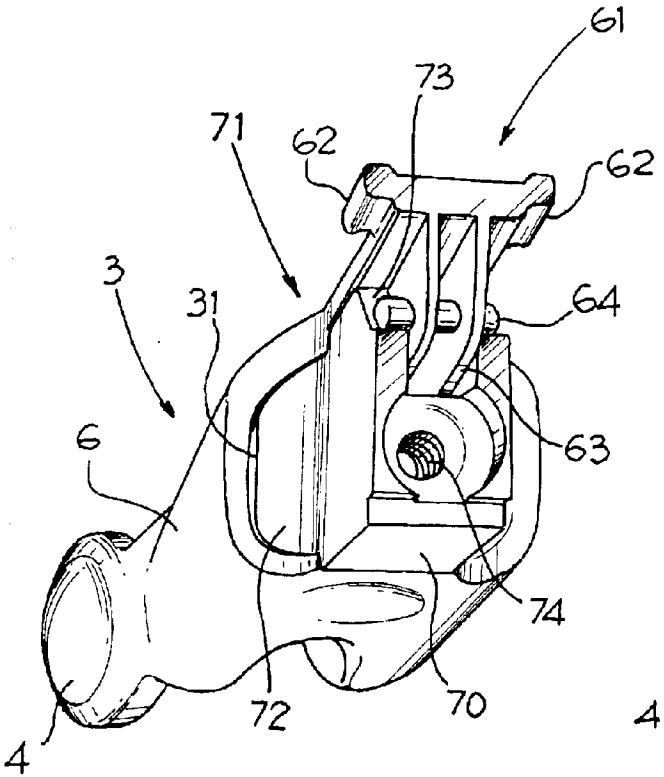
FIG. 4 shows a rear perspective view of the shower support.

As it can be seen in FIGS. 3 and 4, tongues 72 are arranged at the front visible side of sliding rail 1, whereas tongues 82 are arranged in the rear side of the same sliding rail 1 so as to define a sliding guide relative to slotting 40.

Figure 3A:
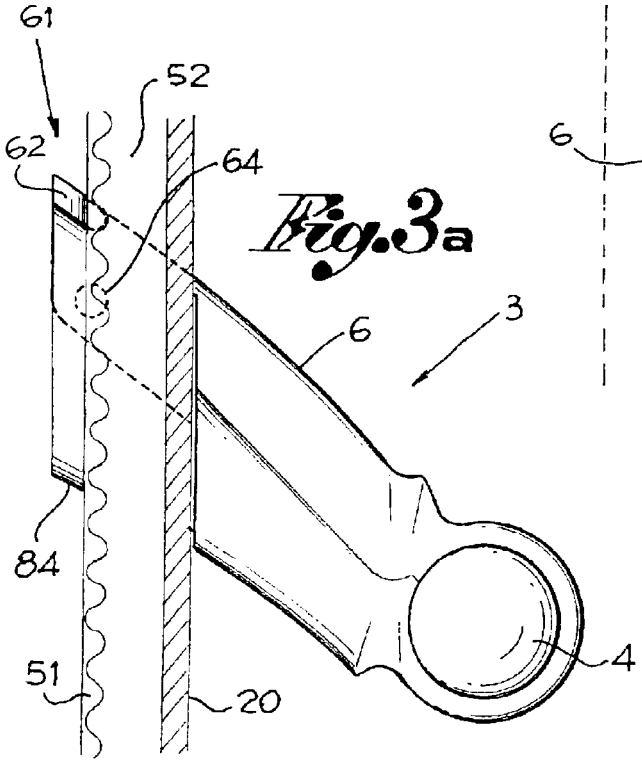
FIG. 3*a* shows a longitudinal section view of the sliding rail and the shower support after height adjustment.
Figure 5:
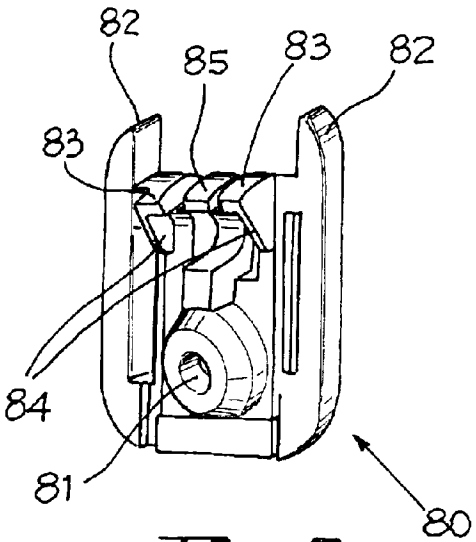
FIG. 5 shows a front perspective view of another component of the support of FIG. 4.
Figure 6:
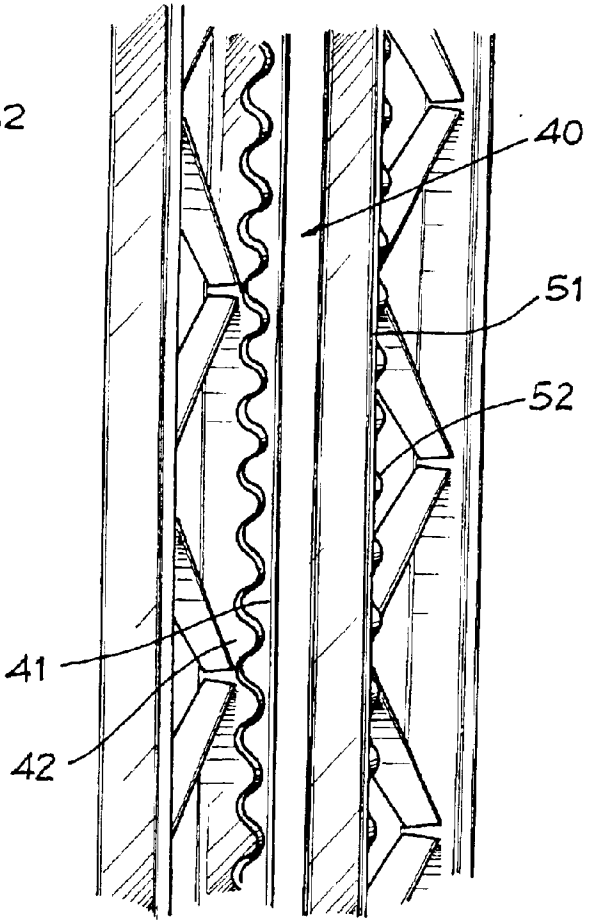
FIG. 6 shows a rear perspective view of a portion of the sliding rail.

As can be seen in FIG. 3 and 3*a*, the horizontal pivoting of support 3 relative to the group consisting of plaque or plate 80 and block 70, causes the insertion or removal of teeth 62 from the notches on ribs 42, 52, thereby allowing the locking or sliding, respectively, and the height adjustment, of support 3 on sliding rail 1.

What is claimed is:

1. A height adjustable shower arrangement for mounting on a wall, the arrangement comprising:

a rail including first and second struts spaced from each other to define a slot, each of said struts being curved with a concave side;

end plugs connected to ends of said first and second struts, said end plugs having one side for mounting on the wall and holding said concave side of said first and second struts facing the wall;

first and second ribs mounted on said concave side of said first and second struts respectively.

2. A shower arrangement according to claim 1, comprising a support for a shower suitably inserted into an adjustable head, wherein the support exhibits a body inside in which there is obtained a recess and in that said support exhibits an appendix or extension onto which on its opposite sides there are obtained two teeth intended to interact with notches provided on the ribs.

3. A shower arrangement according to claim 2, wherein: on a lower face of the appendix there is provided a plate-shaped rib laying on a plane orthogonal to the lower face of the appendix, exhibiting orthogonal, coaxial through holes wherein a pin is housed.

4. A shower arrangement according to claim 3, wherein: the recess is intended to partly house a block including a central body which develops from two tongues, each arranged at sides of said body, complementary to the recess, in an upper part of said body there being provided two cradles cooperating with free ends of the pin and, in a lower part, there being provided a threaded hole.

5. A shower arrangement according to claim 4, wherein complementary to the block there is provided a plaque exhibiting a central through hole, two side tongues, two teeth defining two undercuts and a central tooth, said undercuts being configured so as to enclose the free portions of the pin.

6. A shower arrangement according to claim 5, wherein said block and said plaque are firmly connected to one another by a bolt passing through the hole to engage a group including the block and the plaque to the support through the pin and allow the support to horizontally pivot relative to said group.

7. A shower arrangement according to claim 6, wherein said block and said plaque are respectively arranged at a front visible side and at a rear side of the rail so that tongues on said block and plaque define a sliding guide for the support on the slotting, said sliding being allowed by horizontal pivoting of the support relative to the group and by consequent insertion or removal of the teeth into or from the notches provided on the ribs for height adjustment of the support.

8. A shower arrangement according to claim 1, further comprising:

a support for a shower head, said support including an extension slidably arranged in said slot of said rail;

first and second teeth arranged on said extension to be selectively engageable with respective said first and second ribs on said struts.

9. A shower arrangement according to claim 8, further comprising:

a first plate arranged on said concave side of said struts;

a second plate arranged on a convex side of said struts diametrically opposite said concave side, said first and second plates being connected to each other to slide along said slot;

said support being pivotally connected to said first and second plates to have said first and second teeth selectively engage with said first and second ribs.

10. A combined sliding rail with support for height-adjustable shower, comprising a rod delimited by end plugs for mounting on a wall, the rod including two standards having sides reciprocally defining a slotting that substantially develops for a full length of the rail;

wherein facing the mounting wall, and adjacent the sides of the slotting, there are provided two ribs, one for each side, and defining a rack;

a support for a shower suitably inserted into an adjustable head, wherein the support exhibits a body inside in which there is obtained a recess and in that said support exhibits an appendix or extension, onto opposite sides of which there are obtained two teeth intended to interact with notches provided on the ribs.

* * * * *